US005543894A

United States Patent [19]

Carolan

[11] Patent Number: 5,543,894

[45] Date of Patent: Aug. 6, 1996

[54] CORRECTION FOR SURFACE VELOCITY MISMATCH IN MULTIPLE SERVO PAPER PATHS

[75] Inventor: Kevin M. Carolan, Webster, N.Y.

[73] Assignee: Xerox Corporation, Stamford, Conn.

[21] Appl. No.: 276,376

[22] Filed: Jul. 18, 1994

[51] Int. Cl.[6] ..... G03G 21/00

[52] U.S. Cl. ..... 355/208; 355/308

[58] Field of Search ..... 355/208, 207, 355/204, 205, 308, 309

[56] References Cited

U.S. PATENT DOCUMENTS

| | | | |
|---|---|---|---|
| 4,541,709 | 9/1985 | Kampschreur | 355/208 X |
| 4,928,141 | 5/1990 | Poehlein | 355/208 |
| 4,947,209 | 8/1990 | Maeno | 355/204 |
| 5,086,319 | 2/1992 | Carolan | 355/317 |
| 5,130,748 | 7/1992 | Tanaka | 355/206 |
| 5,235,392 | 8/1993 | Hediger | 355/271 |

*Primary Examiner*—Nestor R. Ramirez
*Attorney, Agent, or Firm*—Ronald F. Chapuran

[57] ABSTRACT

An image processing apparatus, a first servo system has a closed loop digital control with a first reference control signal for driving a photosensitive member, and a second servo system has a closed loop digital control with a second reference control signal for driving a prefuser transport, and a master control responds to the servo system closed loop digital controls to synchronize the speed of the prefuser transport with the speed of the photosensitive member.

7 Claims, 2 Drawing Sheets

CORRECTION FOR SURFACE VELOCITY MISMATCH IN MULTIPLE SERVO PAPER PATHS

BACKGROUND OF THE INVENTION

The invention relates to multiple servo systems, in particular to the correction for surface velocity mismatch in multiple paper paths driven by separate servo systems.

For reliable and rapid movement of copy sheets through a reproduction machine, it is important to synchronize various drives and transports. This is important, in particular, in multi-drive machines such as in color machines wherein efficient registration and transfer of sheets is essential to quality output. For example, when two or more servo systems are driving the same sheet of paper, one surface is often slightly faster than the other surface (due to drive roll diameter tolerance). This causes the servo systems to oppose each other (causing a torque disturbance) resulting in image degradation. A very critical application would be the copy paper transition between a photoreceptor and a prefuser transport in a reproduction machine. In a color machine where photoreceptor motion is of extreme importance, the actual surface speed of the prefuser transport must be very close to that of the photoreceptor to avoid this image degradation.

It would be desirable, therefore, to be able to adjust one or more of the drives or servo systems in a multiple drive system to reduce opposing or counteracting forces and eliminate image degradation. It is an object, therefore, of the present invention to provide a new and improved system for compensating for the adverse effect of a drive system on the movement of a copy sheet. Another object of the present invention in multiple paper path servo systems is to be able to detect and correct for copy sheet or surface velocity mismatch. Other advantages of the present invention will become apparent as the following description proceeds, and the features characterizing the invention will be pointed out with particularity in the claims annexed to and forming a part of this specification.

SUMMARY OF THE INVENTION

A control monitors digital compensator outputs for discrete copy sheet drives at the time of transitions from transport to transport to detect any mismatch in surface velocity. Once a velocity mismatch is detected, a given servo can be adjusted through a command bus to correct for the surface velocity mismatch. In particular, a first servo system has a closed loop digital control with a first reference control signal for driving a photosensitive member, a second servo system has a closed loop digital control with a second reference control signal for driving a prefuser transport, and a master control responds to the servo system closed loop digital controls to synchronize the speed of the prefuser transport with the speed of the photosensitive member.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
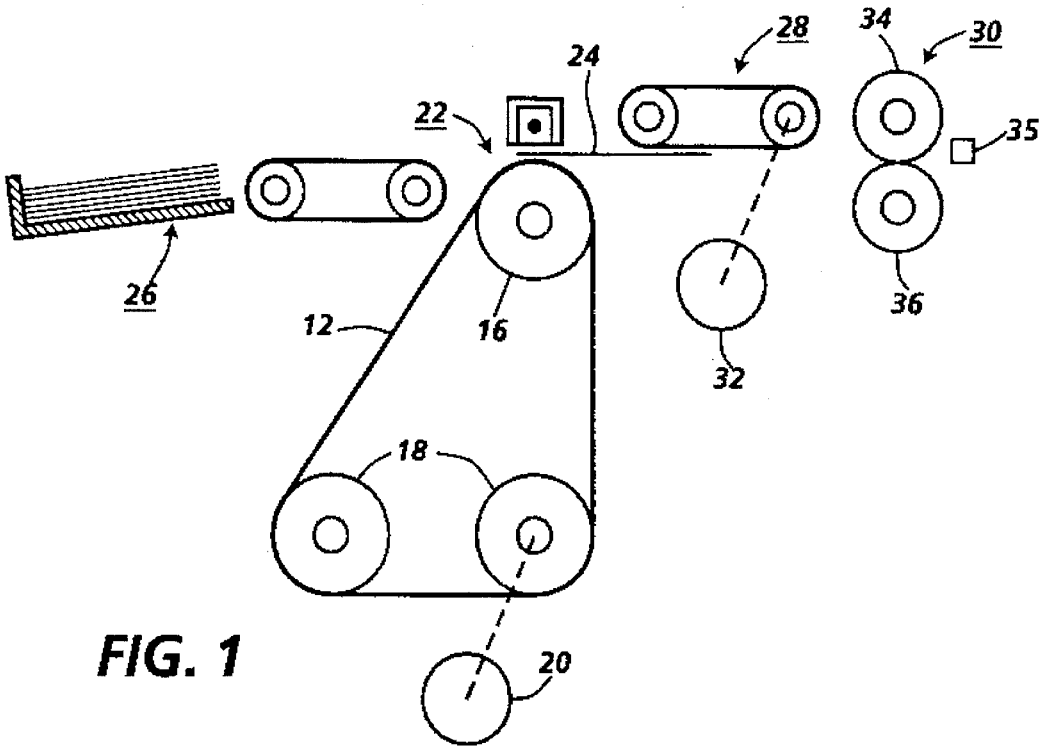
FIG. 1 is an exploded view illustrating the principal mechanical components incorporating the present invention.

Referring to FIGS. 1 there is shown a photoreceptor surface 12 wrapped over supporting rolls, 16, and 18 and driven by a first servo system 20. At transfer station 22, a developed toner image on photoreceptor surface 12 is transferred to a copy sheet 24 suitably supplied from a copy sheet source 26. The copy sheet 24 is then immediately stripped from the photoreceptor surface 12 for engagement by a prefuser transport 28 to be delivered to fuser 30 for permanently fixing the toner image to the copy sheet. Preferably, fuser 30 includes a heated fuser roller 34 and a pressure roller 36 with the powder image on the copy sheet contacting fuser roller 34. After fusing, a suitable sensor 35 detects the absence or presence of a copy sheet leaving fuser 30 and the copy sheets are then advanced to an appropriate not shown output tray or finishing station.

The prefuser transport 28 is driven by a second servo system 32 and the stress or tension placed upon the copy sheet 24 when overlapping both roll 16 and prefuser transport 28 is a function of the speed of the photoreceptor surface at roll 16 and the speed of the prefuser transport. The relative speed of the photoreceptor surface at roll 16 and the speed of the prefuser transport 28 is, in turn, a function of the power delivered to the photoreceptor surface by the first servo system and the power delivered to the prefuser transport by the second servo system.

In particular, if the speed of the prefused transport 28 is greater than the speed of the photoreceptor surface at roll 16, then there will be a tendency for the prefuser transport to pull the copy sheet away from the photoreceptor surface at roll 16. On the other hand, if the speed of the prefuser transport 28 is less than the speed of the photoreceptor surface at roll 16, there will be a tendency of the photoreceptor surface at roll 16 to push the copy sheet ahead of the prefuser transport 28, often times causing the sheet to warp or buckle. In either case, smudging or other degradation of the developed image on the copy sheet will occur to the detriment of the quality of the finished product.

Figure 2:
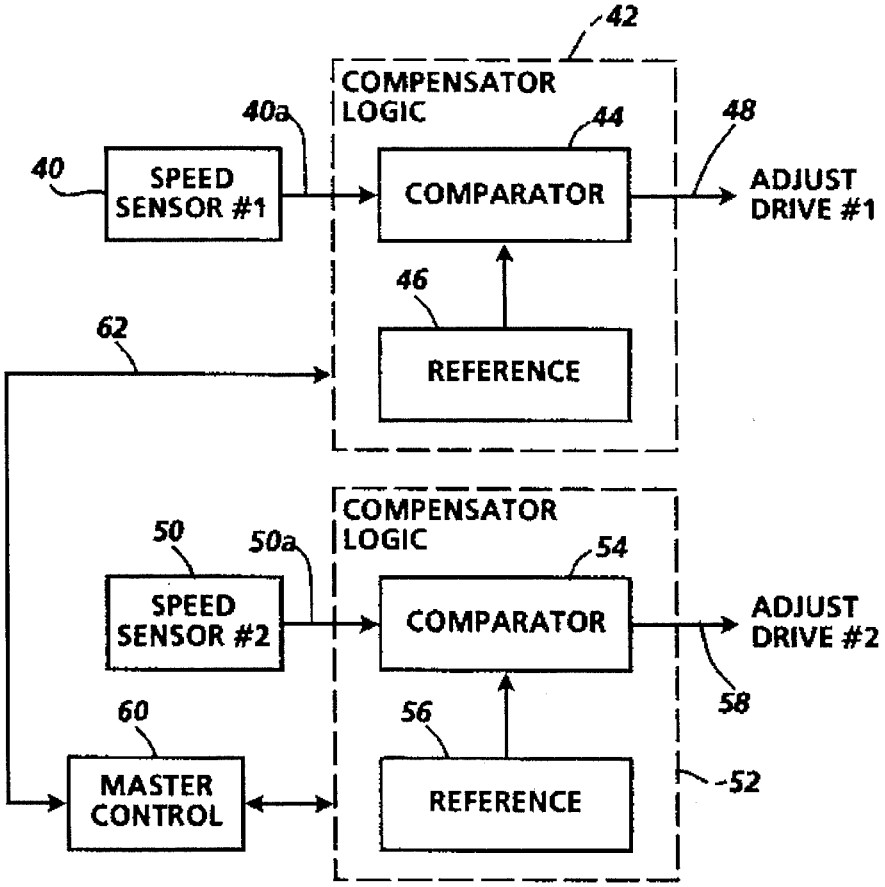
FIG. 2 is a block diagram depicting the major control elements of the components shown in FIG. 1.

With reference to FIG. 2, i n accordance with the present invention, a motor or drive speed sensor 40 disposed adjacent the roll 16 determines the velocity or speed of the photoreceptor 12 at roll 16. A suitable signal 40A is conveyed from the speed sensor to compensate or logic generally shown at 42 including comparator 44 and a reference signal 46 to be further described with reference to FIG. 3. The comparator 44 responds to the input signal 40*a* from speed sensor 40 and the reference signal 46 to provide a signal 48 to adjust servo system 20 to control the speed of the photoreceptor surface 12. In a similar manner, speed sensor 50 disposed adjacent the prefuser transport 28 determines the surface velocity or speed of the prefuser transport and provides a signal 50*a* to compensator logic 52 including comparator 54 and reference signal 56. The comparator 54 responds to the input signal 50*a* from the speed sensor 50 and a reference signal 56 to provide a servo system adjust signal 58 to adjust servo system 32 controlling the speed of the prefuser transport 28. Both the compensator logic 42 and compensator logic 52 are interconnected to master control 60 via a two way communication link illustrated at 62. Speed sensors 40 and 50 are any suitable speed sensing devices such as an optical disc mounted on the moving element or the motor shaft and a stationary light source and photodetector to record the number of received signals or pulses per given time period.

Figure 3:
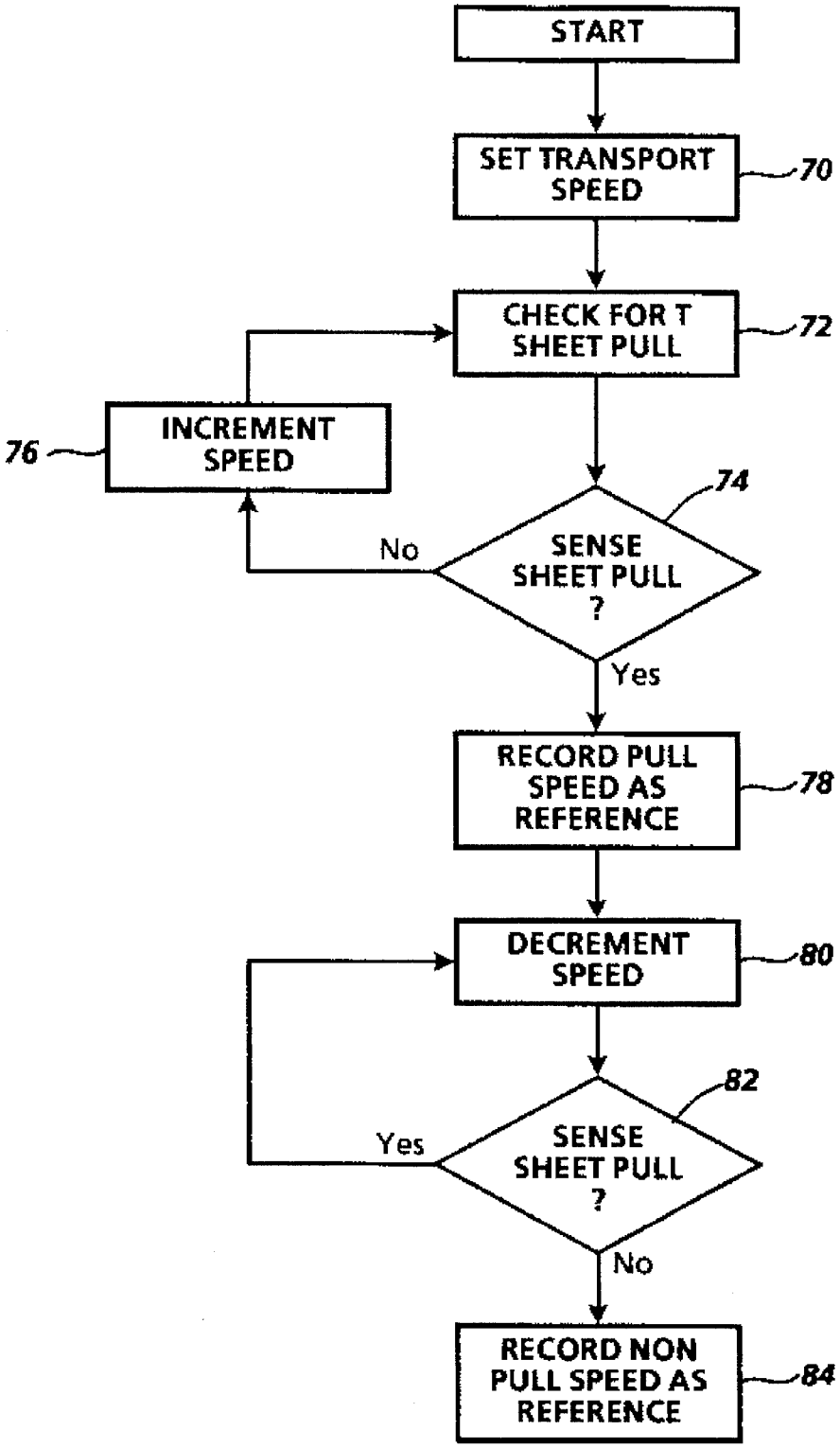
FIG. 3 is a flow chart the drive control reference set up in accordance with the present invention.

With reference to FIG. 3, in accordance with the present invention, there is shown the setting of a reference signal, in particular reference signal 56 for servo system 32. Initially, the speed of the prefuser transport 28 is set at a given value as shown at block 70. At block 72 there is a check for sheet pull. Sheet pull at the prefuser transport can be determined by sensing a lower demand for power at the photoreceptor surface servo system 20. That is, assuming that the prefuser transport 28 and the photoreceptor surface 12 were travelling at the same surface speed, there would be a smooth flow of the copy sheet 24 between the photoreceptor surface and the prefuser transport. However, as the prefuser transport speed increases beyond the photoreceptor surface at roll 16, the prefuser transport 28 tends to pull the copy sheet from the photoreceptor surface. This external power to pull the copy sheet away from the photoreceptor surface is sensed by the servo system 20 as an indication of less power required at servo system 20 to deliver the copy sheet 24. Thus, the determination of the copy sheet pull by the prefuser transport can be determined by a sensed power change at the compensator logic 42 of servo system 20 controlling the movement of the photoreceptor surface 12.

Thus, at decision block 74 there is a determination of whether or not there is a sensed sheet pull. If not, the speed of the prefuser transport is incremented as shown at 76 to again check for sheet pull at 72. This process is repeated until the speed of the prefuser transport has increased to a sufficient speed to sense a copy sheet pull at the prefuser transport. Upon detection of a copy sheet pull, the pull speed reference is determined as shown at block 78.

In a similar manner, the precise point or speed of the prefuser transport in which a no pull condition is sensed is determined by decreasing the speed of the prefuser transport 28 from the speed at the pull condition. As illustrated at block 80, once there has been a recording or determination of the speed of the prefuser transport for a pull condition, the speed is incrementally decreased and at each decreased increment a determination is made whether or not there is a sheet pull as illustrated at decision block 82. Similar to the pull condition, a sensed condition of no pull is determined by the speed of the photoreceptor surface at roll 16 at a speed sufficient to keep up with the speed of the prefuser transport. This condition is a function of the power delivered by the photoreceptor servo system 20 to drive the photoreceptor surface 12 at roll 16. At the point of sensing of a no pull condition of the copy sheet by the prefuser transport, this speed is likewise reported as a reference speed as illustrated at block 84.

In operation, in one embodiment, without any paper at the photoreceptor transfer station 22, a measurement is made of the average output of the compensator logic 42 to drive the servo system 20. Then, using a suitable paper path sensor and timer, the time that the paper reaches the photoreceptor surface 12 at the transfer station is determined. Once the paper has reached the prefuser transport 28 from the transfer station, a determination is made whether or not the compensator logic 42 output increases or decreases. If the output of the compensator logic 42, signal 48, to the servo system 20 decreases, a determination is made that the prefuser transport 28 is pulling the copy sheet from the transfer station at roll 16. By monitoring the velocity of the servo systems by way of the output of the compensator logic 42 and 52, the master control 60 responds and adjusts the references 46 and 56 to synchronize the surface speed of the photoreceptor surface at roll 16 and the prefuser transport speed.

It should be noted that the above description is merely one embodiment and other suitable logic arrangements to adjust independent servo systems is contemplated within the scope of this invention. In other words, if there is a speed mismatch between two copy sheet drives such as the prefuser transport 28 driven by servo system 32 and the photoreceptor surface speed at roll 16 driven by servo system 20, synchronization of the speed can be accomplished by a relative adjustment of the two servo systems. That is, if there is a mismatch of the speed of the surfaces driven by the separate servo systems, adjustment can be made by slowing down the surface speed of one of the servo systems via the compensator or adjustment logic or speeding up the other surface driven by the second servo system, or any combination of speed adjustment of both of the servo systems through suitable compensator logic to synchronize the speed of a copy sheet moving from one drive system to another drive system. In other words, the outputs of the digital compensators can be monitored at the time of a transition of a copy sheet or other document from one transport to another transport to detect any mismatch of surface velocity. Once the velocity mismatch is detected, a servo system reference can be adjusted through a suitable command channel to a master control to correct for the surface velocity mismatch.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

I claim:

1. In a reproduction machine comprising a control, a first servo system for driving a photosensitive member and a second servo system for driving a prefuser transport, the photosensitive member transferring an image to a copy sheet at a transfer station, the copy sheet being driven by the second servo system from the transfer station to a fuser station, a method of synchronizing the speed of the photosensitive member with the speed of the prefuser transport comprising the steps of:

storing first data in memory representing a surface velocity of the prefuser transport being greater than the surface velocity of the photosensitive member, storing second data in memory representing a surface velocity of the prefuser transport being equivalent to the surface velocity of the photosensitive member, the first data in memory being a reference value in the first servo system and the second data in memory being a reference value in the second servo system, and responsive to the first and second data, synchronizing the speed of the prefuser transport with the speed of the photosensitive member.

2. The reproduction machine of claim 1 wherein the servo systems include digital compensators for providing adjustment signals in response to comparing a sensed, servo system speed signal with a speed reference signal.

3. The reproduction machine of claim 1 including circuitry for adjusting at least one of the reference valves.

4. The reproduction machine of claim 1 wherein at least one of the servo systems includes a digital compensator for providing adjustment signals in response to comparing a sensed, servo system speed signal with a speed reference signal.

5. In a reproduction machine comprising a control, a first servo system for driving a photosensitive member and a second servo system for driving a prefuser transport, the photosensitive member transferring an image to a copy sheet at a transfer station, the copy sheet being driven by the second servo system from the transfer station to a fuser station, a method of synchronizing the speed of the photosensitive member with the speed of the prefuser transport comprising the steps of:

increasing the speed of the prefuser transport with a copy sheet spanning the transfer station and prefuser transport until a determination of a copy sheet pull indication, decreasing the speed of the prefuser transport with a copy sheet spanning the transfer station and prefuser transport to recognize the absence of the copy sheet pull indication, responsive to the speed of the prefuser transport at the copy sheet pull indication and the speed of the prefuser transport at the absence of the copy sheet pull indication, setting reference data in the control, and responsive to the reference data synchronizing the speed of the prefuser transport with the speed of the photosensitive member.

6. The method of claim 5 wherein the step of increasing the speed of the prefuser transport with a copy sheet spanning the transfer station and prefuser transport until a determination of a copy sheet pull indication is determined by a decrease in motor voltage at the first servo system.

7. The method of claim 5 wherein the step of decreasing the speed of the prefuser transport with a copy sheet spanning the transfer station and prefuser transport to recognize the absence of the copy sheet pull indication is determined by an increase in motor voltage at the first servo system.

* * * * *